US005841050A

United States Patent [19]

Clift et al.

[11] Patent Number: 5,841,050

[45] **Date of Patent: *Nov. 24, 1998**

[54] METHOD AND APPARATUS FOR OPTICALLY DETERMINING NOTE CHARACTERISTICS FROM KEY MOTION IN A KEYBOARD OPERATED MUSICAL INSTRUMENT

[75] Inventors: Pamela K. Clift, Vacaville; Charles R. Lee, Placerville, both of Calif.

[73] Assignee: Burgett, Inc., Sacramento, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 658,486

[22] Filed: Jun. 10, 1996

Related U.S. Application Data

[63] Continuation-in-part of Ser. No. 395,459, Feb. 27, 1995, Pat. No. 5,524,521.

[51] Int. Cl.[6] ..... G10D 3/04

[52] U.S. Cl. ..... 84/462; 84/658

[58] Field of Search ..... 84/461, 462, 645, 84/626, 658, 670, 236, DIG. 7, 687, 718, 724

[56] References Cited

U.S. PATENT DOCUMENTS

| | | | |
|---|---|---|---|
| 3,511,569 | 5/1970 | Mackta | 356/28 |
| 3,617,627 | 11/1971 | McLean | 178/17 R |
| 3,799,671 | 3/1974 | Schweizer | 356/28 |
| 3,900,262 | 8/1975 | Baxter | 356/28 |
| 4,037,511 | 7/1977 | Del Castillo | 84/478 |
| 4,362,934 | 12/1982 | McLey | 250/229 |
| 4,468,999 | 9/1984 | Bonanno | 84/1.1 |
| 4,674,069 | 6/1987 | Mizuno | 367/90 |
| 4,686,880 | 8/1987 | Salani et al. | 84/1.01 |
| 4,736,662 | 4/1988 | Yamamoto | 84/1.09 |
| 4,790,230 | 12/1988 | Sanderson | 84/462 |
| 4,970,928 | 11/1990 | Tamaki | 84/21 |
| 5,194,685 | 3/1993 | Kawamura et al. | 84/670 |
| 5,200,562 | 4/1993 | Kaneko et al. | 84/21 |
| 5,237,125 | 8/1993 | Fields | 84/626 |
| 5,451,708 | 9/1995 | Fujiwara et al. | 84/21 |
| 5,567,902 | 10/1996 | Kimble et al. | 84/658 |

*Primary Examiner*—William M. Shoop, Jr.
*Assistant Examiner*—Shih-yung Hsieh
*Attorney, Agent, or Firm*—John P. O'Banion

[57] ABSTRACT

A method and apparatus for accurately sensing key motion in a keyboard operated musical instrument, in which optical emitters and sensors are positioned adjacent to the keys. The optical emitters and sensors are arranged on a plurality of individually addressable sensor boards, and the sensor boards are divided into a plurality of individually addressable sensor banks. Each sensor board is independently and sequentially activated by a controller according to a specified timing sequence. As the controller activates a sensor board in one bank, allowing the board to warm up, another sensor board in the second bank, which has previously been activated and warmed up, is read and analyzed by the controller. Activation and reading of sensor boards alternates between sensor banks as the sensor boards are sequenced through. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained.

8 Claims, 7 Drawing Sheets

METHOD AND APPARATUS FOR OPTICALLY DETERMINING NOTE CHARACTERISTICS FROM KEY MOTION IN A KEYBOARD OPERATED MUSICAL INSTRUMENT

CROSS-REFERENCE TO RELATED APPLICATIONS

This application is a continuation-in-part of application Ser. No. 08/395,459 filed on Feb. 27, 1995, now U.S. Pat. No. 5,524,521, which is incorporated herein by reference.

BACKGROUND OF THE INVENTION

1. Field of the Invention

This invention pertains generally to sensing key motion in keyboard operated musical instruments, and more particularly to a method and apparatus for dynamically sensing motion of the keys in a piano and determining velocity and duration characteristics of a played note for electronic recording.

2. Description of the Background Art

Accurate recording of musical expression from a keyboard operated musical instrument such as a piano has long been of interest to musicians, composers, and listeners. Early versions of recording devices punched holes in paper ribbons or rolls for reproduction of musical notes by a "player piano." Advances in electronic and optical technologies have led to the development of more sophisticated and accurate sensing and recording means for keyboard instruments.

The availability of inexpensive and increasingly powerful data processing devices has further propelled development of keyboard recording systems. Sensing and recording systems now exist which are interfaced with microprocessors, with electronically or optically generated key information being digitized and interpreted by software. A standardized communication format for such software has been developed in the music industry under the name Musical Instrument Digital Interface or "MIDI."

Several devices, systems, and methods employing electronic or optical sensors on keyboard instruments are known. A drawback of prior methods and devices, however, is that the sensors tend to generate an "on" and "off" type of output from reading key movement, resulting in omission of a great deal of musical expression information. Therefore, there is a need for an apparatus and method for sensing and recording musical expression generated by keyboard instruments which accurately records musical expression generated by keyboard instruments such as the piano, which does not require software modification for different designs and manufactures of piano, which is quick and easy to install, which does not sacrifice keyboard space, and which does not detract from the aesthetic appearance of the piano. The present invention satisfies these needs, as well as others, and generally overcomes the deficiencies found in the background art.

SUMMARY OF THE INVENTION

The present invention pertains generally to a method and apparatus for accurate optical sensing of the motion of the keys in a piano. The invention is quick and easy to install and use, and can be uniformly applied to pianos of different manufacture and design without requiring modification of the controlling software.

In general terms, the present invention comprises arrays of optical sensors which are positioned adjacent to, and preferably below, the piano keys. A plurality of sensors are generally arranged on individual sensor boards, with a plurality of sensor boards comprising a sensor bank.

By way of example and not of limitation, the present invention includes eighty-eight optical sensors for detecting motion of each of the eighty-eight keys in a typical piano. The exact number of sensors would depend on the number of keys in the particular instrument. Preferably, one to eight optical sensors are mounted on an individual sensor board, with the optical sensors positioned and spaced-apart on the board to corresponding to the spacing between piano keys. The sensor boards are preferably arranged into two sensor banks, with each sensor bank comprising six to eight sensor boards. Each of the two sensor banks generally monitors the movement of one half of the eighty-eight piano keys.

The sensor boards in each of the two sensor banks are electrically connected together by a common bus, with each of the sensor banks having a separate and independent common bus. Each sensor bank is interfaced with a separate analog to digital or A/D converter which digitizes the analog output of the sensors. The A/D converters are interfaced with controlling data processing means, such as a microprocessor, which directs the activation of each sensor board and acquisition of the sensor data. From this digitized information, the microprocessor generates musical information based on the note velocity and duration sensed from the varying positions of the key. The musical information may be in MIDI or other digital format, and is stored on electronic storage media.

In operating the invention, each sensor board is independently and sequentially activated by the microprocessor according to a specified timing sequence. As the microprocessor activates a sensor board in one bank, allowing the board to warm up, another sensor board in the second bank, which has previously been activated and warmed up, is read and analyzed by the microprocessor. This overlapping of sensor board activation and reading, which is made possible by the preferred arrangement of the dual sensor banks as well as the data acquisition method employed, provides for a higher throughput of data conversion than has been heretofore achieved, and thus more efficient sensing and recording of musical expression information from keyboard instruments than has been previously attained. An alternative method is to turn both boards on at the same time, then (after a warm up period) read one board immediately followed by a read of the second board. Both methods are acceptable for quick and accurate key position measurements.

An object of the invention is to provide an apparatus and method for sensing and recording musical expression from keyboard instruments which optically senses position and velocity of the keys of keyboard instruments.

Another object of the invention is to provide an apparatus and method for sensing and recording musical expression from keyboard instruments which is quick and easy to install and use.

Another object of the invention is to provide an apparatus and method for sensing and recording musical expression from keyboard instruments which is mounted internally within the keyboard instrument and does not interfere with the musical performer or the aesthetic appearance of the instrument.

Another object of the invention is to provide an apparatus and method for sensing and recording musical expression from keyboard instruments which can be uniformly applied to all designs and manufactures of pianos without requiring modification of the controlling software.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more particularly to the drawings, for illustrative purposes the present invention is embodied in the method and apparatus for optically sensing and recording key motion of keyboard musical instruments generally shown in FIG. 1 through FIG. 9. It will be appreciated that the invention may vary as to configuration and as to details without departing from the basic concepts as disclosed herein.

Figure 1:
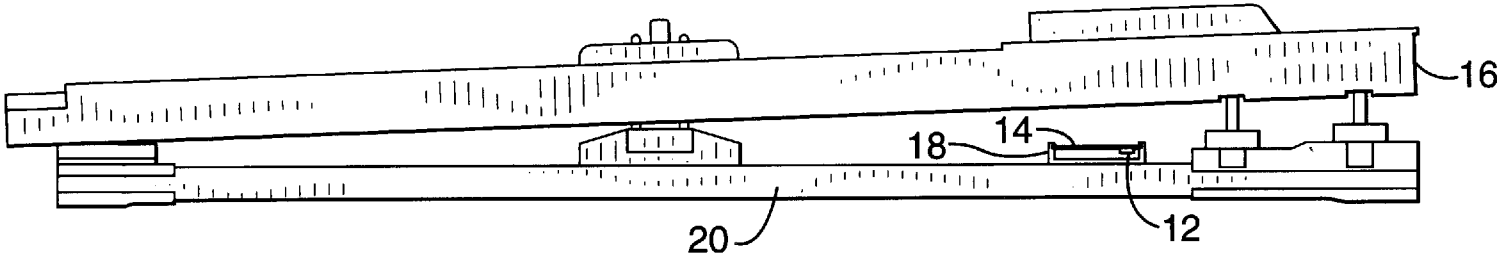
FIG. 1 is a side elevational view of a sensor board and sensor mounted below a keyboard in a proximal position.
Figure 2:
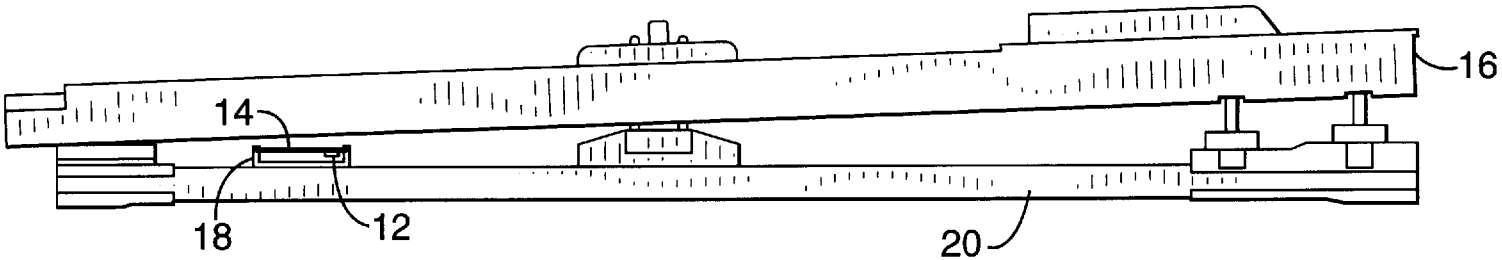
FIG. 2 is a side elevational view of a sensor board and sensor mounted below a keyboard in a distal position.
Figure 3:
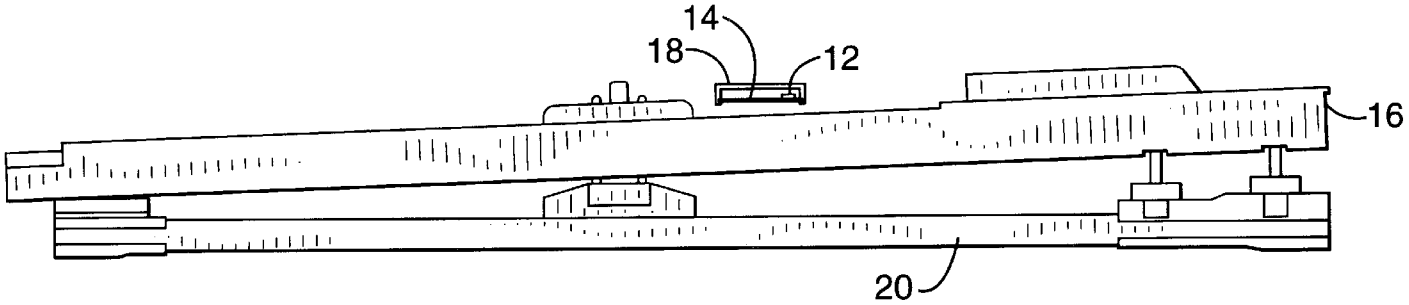
FIG 3 is a side elevational view of a sensor board and sensor mounted above a keyboard in a proximal position.

Referring first to FIG. 1 through FIG. 4, an apparatus for optically sensing key motion in a piano or other keyboard musical instrument in accordance with the present invention includes a plurality of optical sensors 12, each of which is mounted on a sensor board 14, which is in turn mounted adjacent to keys 16 as shown. FIG. 1 and FIG. 2 show alternate positions for mounting the sensor boards below the keys, while FIG. 3 shows an example of the sensor boards being mounted above the keys. Preferably, the sensor boards are mounted below the keys as described herein because they are easier to mount without interfering with the performer or the adversely impacting the aesthetic appearance of the instrument. However, those skilled in the art will appreciate that the exact positioning of the sensors and sensor boards can vary.

The sensor boards 14 can be attached to a rail 18 or the like, which is mounted below the keyboard on a rail support 20. Each optical sensor 12 is generally a single device or package such as a Kodenshi SG107 or the like, which includes two basic components; a light emitting diode or LED 22, which outputs a narrow beam of light, and a photodetector or phototransistor 24. LED 22 is preferably a GaAs or GaAsP type device which emits red light at a wavelength of approximately 980 nanometers. Light 26 is transmitted from LED 22 toward a key 16 where it is intercepted and reflected back toward photodetector 24.

Figure 4:
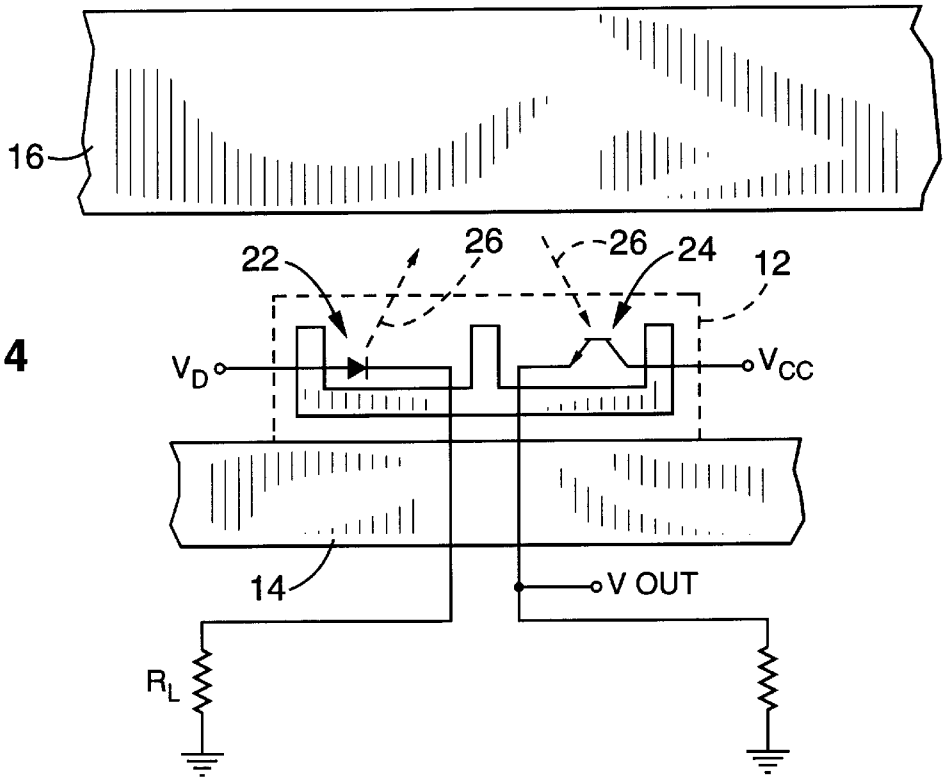
FIG. 4 is a schematic detailed view of the sensor shown in FIG. 1 through FIG. 3.
Figure 5:
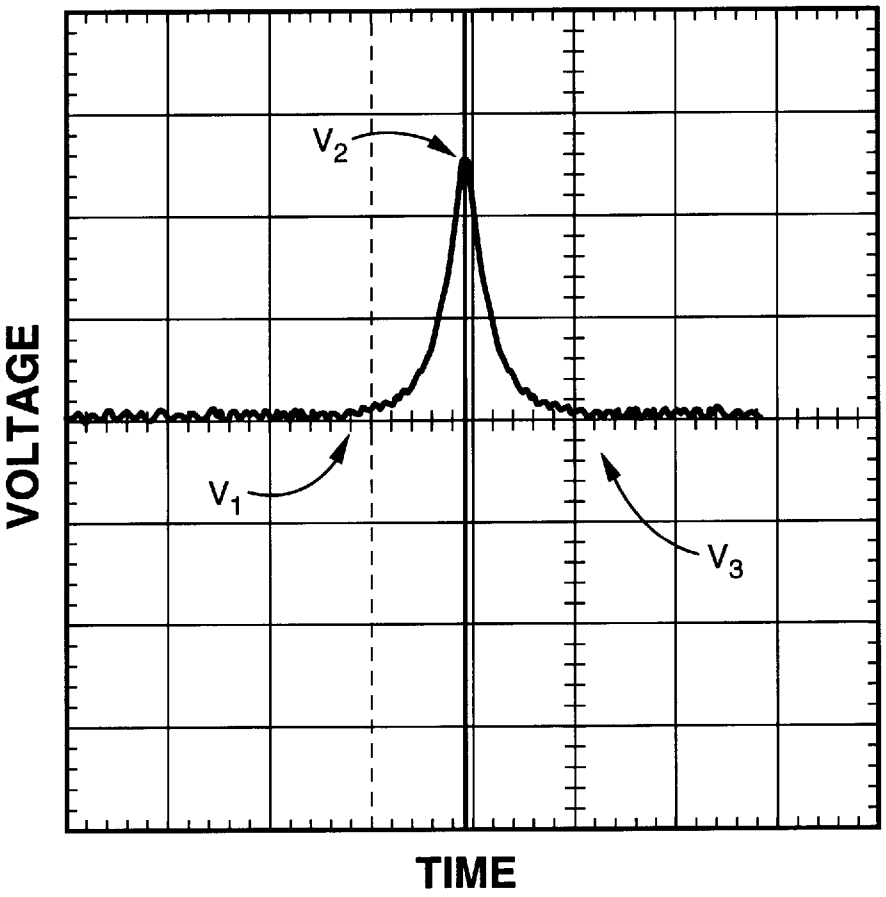
FIG. 5 is a graph showing the relationship of output voltage versus time of the sensor of the present invention as a key moves from the resting position to the strike position to the kickback position and then again to the rest position.

Referring to FIG. 4 and FIG. 5, LED 22 is activated by application of a driving voltage $V_D$ to one of its input terminals, the other input terminal being connected to ground through a current limiting resistor $R_L$. Photodetector 24, which is coupled to a source voltage $V_{CC}$, turns on and produces an analog DC output voltage $V_{OUT}$ proportional to the amount of reflected light sensed by photodetector 24. As can be seen in FIG. 5, the variation of sensor voltage output over the entire range of key motion is generally depicted as voltage output versus time. At $V_1$, key 16 is in its resting position. In this position, key 16 is at its furthest distance from sensor 12, and thus photodetector 24 produces the lowest voltage output. As a player depresses key 16, the key begins to accelerate and the distance between key 16 and sensor 12 decreases, with a corresponding increase in voltage output as more reflected photons reach photodetector 24. At $V_2$, where key 16 is at its closest approach to sensor 12, the voltage output of photodetector 24 is at its maximum, which is where it remains as long as the player keeps key 16 depressed. Upon releasing key 16, the key begins to fall back to the resting position, resulting in the voltage output $V_3$ returning to the same level as $V_1$. Those skilled in the art will appreciate that, if the sensors are mounted above the keys, the voltage output profile described above will be inverted.

Since the distance between sensor 12 and key 16 is known, the velocity of key 16 can be determined from that distance and the time elapsing between voltage outputs $V_1$ and $V_2$. This velocity factor corresponds to the strength of the key depression and the volume of the tone produced, and thus contains important musical expression information. Similarly, the duration of the key depression and thus the musical tone can be determined by the time elapsed between $V_2$ (note on), which corresponds to the actual striking of the string, and $V_3$ (note off), at which point key 16 has returned to its resting position and string vibration is damped.

Figure 6:
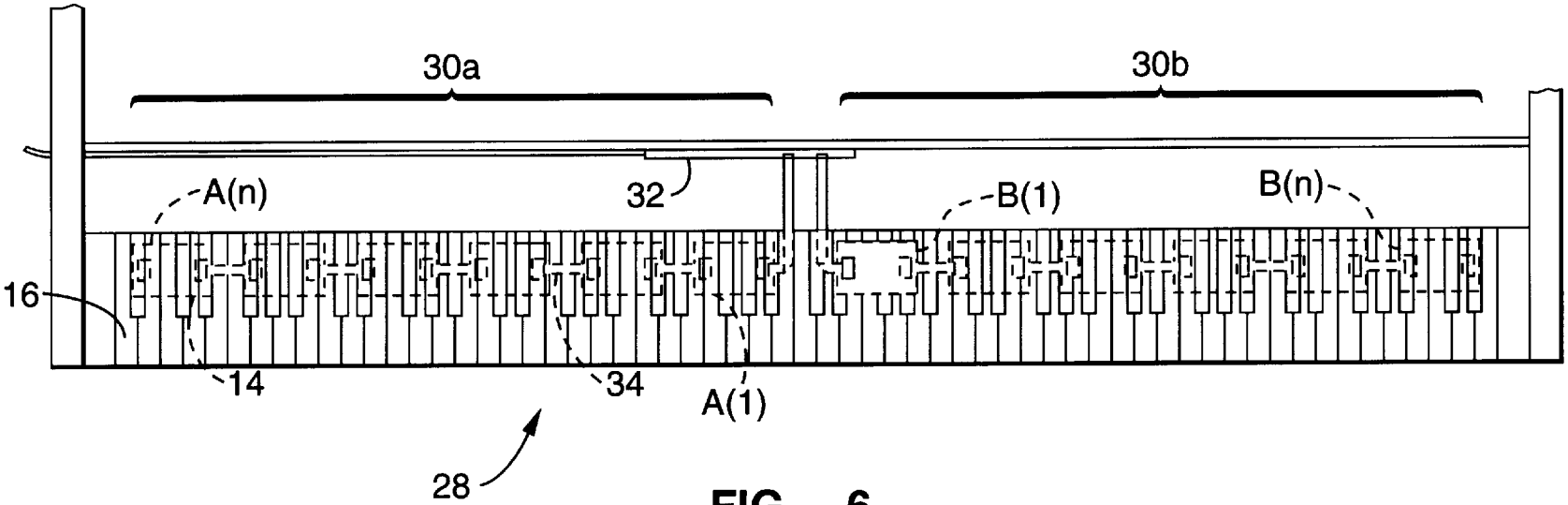
FIG. 6 is a diagrammatic plan view of two banks of sensor boards mounted below the keys in a piano.

Referring to FIG. 6, a typical full size piano keyboard 28 has eighty-eight keys 16. Thus, in a full size keyboard musical instrument, and the present invention thus generally employs eighty-eight sensors 12. Each sensor board 14 contains from one to eight sensors 12, and the sensor boards 14 are arranged into a pair of sensor banks 30*a*, 30*b*. Each sensor bank 30*a*, 30*b* contains six to eight sensor boards 14 and senses the motion of one-half of the eighty-eight keys. Thus, for the typical keyboard musical instrument requiring eighty-eight sensors 12, a variety of combinations of sensors 12 per sensor board 14 and sensor boards 14 per sensor banks 30*a*, 30*b* are possible. Sensor boards 14 are positioned below keys 16 so that sensors 12 are below the approximate lateral midpoint of the key.

Figure 7:
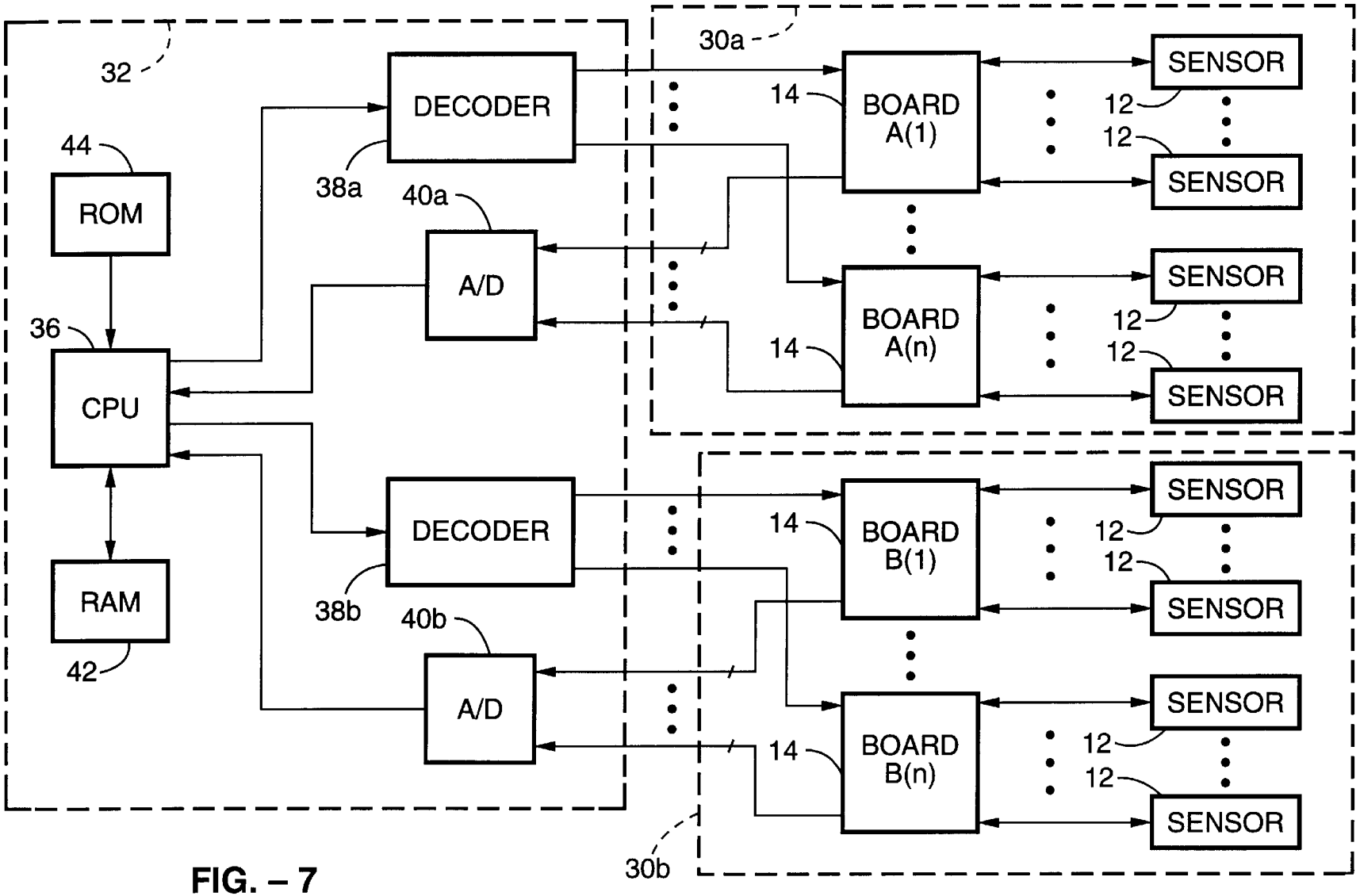
FIG. 7 is a functional block diagram showing the controller processor and sensor configuration of the present invention.

Each sensor board 14 in a sensor bank is individually addressable so that a particular sensor board can be selected by controller 32. Sensor boards 14 are daisy-chained by an interconnecting cable 34, which is ultimately connected to controller 32. Referring also to FIG. 7, controller 32 includes a CPU 36, which is an 8051-type microcontroller or the like. A sensor board 14 in bank 30*a* is addressed by CPU 36 through decoder 38*a* which is a 74HC238 or the like. The voltage outputs of each sensor 12 contained on the sensor board 14 which is so addressed are simultaneously read by a multiplexing A/D convertor 40*a* which is a MAX155 or the like. Similarly, sensor boards in bank 30*b* are addressed through decoder 38*b* and the outputs of the sensors read by A/D convertor 40*b*. Once the sensor voltage outputs are read, the information is stored in RAM 42 and processed by CPU 36. RAM 40 also contains working variables and control programs. CPU 36 monitors the sensor outputs to identify when there have been changes in voltage outputs and the time between those changes. The resulting data is then compared to values in one or more "look-up" tables contained in ROM 44, and is translated to strike velocity (e.g., from the time between $V_1$ and $V_2$ in FIG. 5 and the maximum distance of travel), key position, note duration (e.g., the time between $V_2$ and $V_3$ in FIG. 5) and the like. By making ROM 44 of a flash-type, the "look-up" tables can be updated or modified as desired.

Note that, unlike conventional optical systems, the sensor readings do not simply provide an "on" or "off" state of the key. Instead, the sensors provide the full position of the key at any given moment. The analog voltage output for the entire range of key motion shown in FIG. 5 is digitized and processed by controller 32 to produce musical expression information at a level of accuracy which generally cannot be achieved by conventional systems. The resolution of the musical expression information contained in the key movement is limited only by the capabilities of A/D converters, which is typically 256 positions for an 8 bit A/D converter.

As noted above, when a sensor board is addressed each sensor 12 on that board is simultaneously activated and read by controller 32. The current requirement for this number of sensors operating simultaneously is rather large and, to make the current requirement more practical, it is preferable to pulse the sensors to their on state just before they are read and then turn them off again immediately thereafter. Several sensors may be pulsed on and off together, as long as the total number of sensors on at one time does not exceed the available current. Also, sensors 12 generally require a brief "warm up" time between the time they are pulsed on and the time which their voltage outputs can be read.

Figure 8:
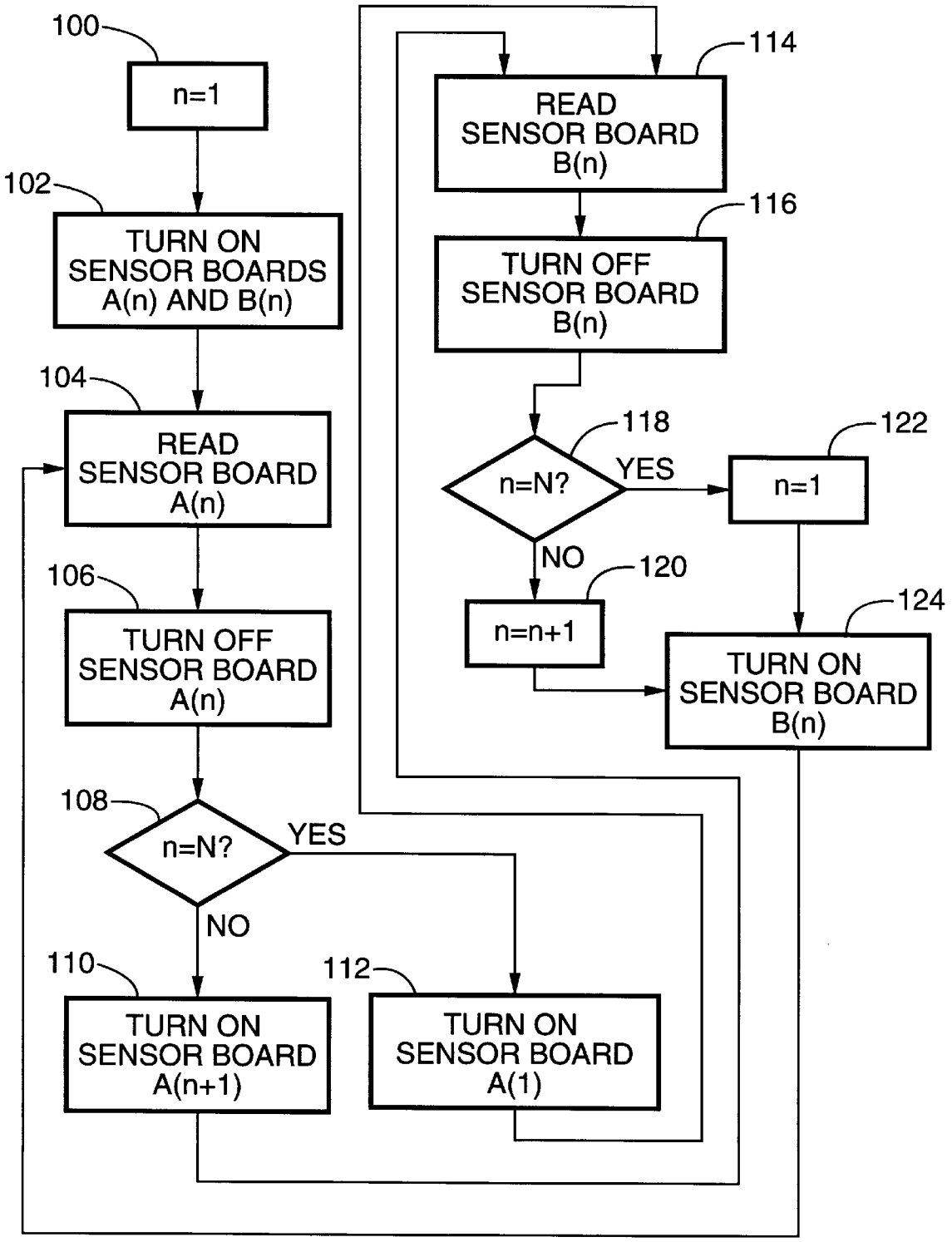
FIG. 8 is a flow chart showing the sensor activation and data acquisition method of the present invention.

Referring also to FIG. 8, controller 32 alternates between sensor banks 30*a*, 30*b* and sequentially activates and reads sensor boards 14 as follows. Designating sensor bank 30*a* as sensor bank A and sensor bank 30*b* as sensor bank B, and assuming that each sensor bank includes a total of N sensor boards, at step 100 the counter n is set to n=1. Next, at step 102, sensor boards A(n) and B(n) are turned on so that they can warm up. Then at step 104, the outputs of the sensors on sensor board A(n) are read. At step 106, sensor board A(n) is turned off. At step 108, the value of counter n is tested against N to determine if all of the sensor boards in sensor bank A have been scanned. If not, at step 110, sensor board A(n+1) is turned on so that it can warm up. Otherwise, sensor board A(1) is turned on at step 112. Next, at step 114, the outputs of the sensors on sensor board B(n) are read. At step 116, sensor board B(n) is turned off. At step 118, the value of counter n is tested against N to determine if all of the sensor boards in sensor bank B have been scanned. If not, at step 120 the value of counter n is incremented to n+1. Otherwise, at step 122 n is reset to n=1. At step 124, sensor board B(n) is then turned on so that it can warm up. This process then continues at step 104.

As can be seen, the data acquisition method of the present invention is designed to have controller 32 select a sensor board to warm up in a first bank, while a sensor board in a second bank, having been previously turned on, can be read and analyzed. After being read, that sensor board in the second bank is turned off, and the next board on the same sensor bank is turned on to warm up. Controller 32 can then read the sensor board in the first bank that was previously turned on. The resultant "overlapping" of sensor boards allows for a high throughput of data. Basically, while one board is being read, another is being warmed up to that it can be immediately read when the first is completed.

Referring again to FIG. 6, in the data acquisition method described above the sensor boards designated as A(1) and B(1) are the preferably the boards in the center of keyboard 26 and closest to controller 32, whereas the sensor boards designated as A(N) and B(N) are the boards at the ends of the chain. Using a scan rate of approximately 25 MHz, the entire keyboard can be scanned in approximately 0.5 $\mu$s. Further, if all of the key positions are sampled in 1 ms or less, the speed of data acquisition will exceed the maximum possible key velocity, so as to provide for an accurate representation of the music being performed. Since A/D convertors 40*a*, 40*b* multiplex the outputs of all of the sensors on a particular sensor board at the same time, data acquisition is further increases.

Accordingly, at selected time intervals a group of sensors are scanned and a mode value is stored which relates to the voltage level sensed. For example, referring again to FIG. 5, mode 0 would correspond to the rest position ($V_1$), mode 1 would correspond to the key moving down, mode 3 would correspond to the strike position ($V_2$), mode 4 would correspond to the key moving up, and mode 5 (or mode 1 again) would correspond to the key in the rest position ($V_3$). Once a key starts moving, a count will be accumulated from which velocity can be determined. When the mode is reached indicating a strike has occurred, MIDI or equivalent data will be recorded for that key. Additionally, when the key returns to rest, MIDI or equivalent data will be recorded.

Figure 9:
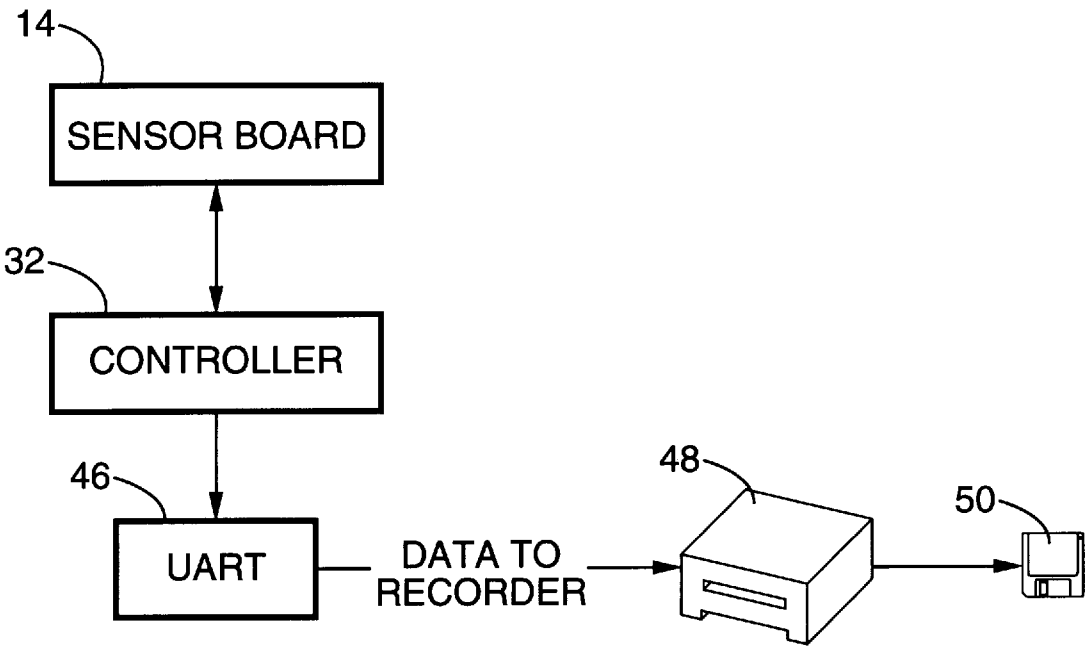
FIG. 9 is a functional block diagram of a musical performance recording apparatus in accordance with the present invention.

Referring to FIG. 9, a conventional UART 46 serves as a communications interface for controller 32 to send data to a recorder 48 for storage on a disk 50. It should be noted, however, that the output data can be presented in any convenient format and that other communications, recording, or storage devices could be used.

While measurement of key movements using conventional devices can produce key velocity and duration results, such measurement presents an inaccurate picture of the actual piano performance. Further, pianos differ in key weights and travel and, therefore, conventional devices must be customized for each piano. The present invention, however, provides for accurately determining piano performance by testing key positions as they go through their full motion cycle. By continuously testing the position of the key at all times, the complete keyboard performance can be analyzed. Further, the present invention can be fitted to any piano without modification. Also, those skilled in the art will appreciate that the method and apparatus of the present invention could be used to dynamically sense proportional movement of the three foot pedals commonly found on a piano.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for determining motion characteristics of selected string striking means in a keyboard operated musical instrument having a plurality of string striking means, comprising:

(a) a plurality of sensor banks, each said sensor bank including a plurality of sensor boards, each said sensor board including a plurality of light emitters and corresponding light sensors, said light emitters and corresponding light sensors positioned adjacent said plurality of string striking means in said keyboard operated musical instrument, each said light sensor producing an output voltage responsive to intensity of sensed light reflected from a corresponding one of said plurality of string striking means in said keyboard operated musical instrument; and (b) control means for addressing said sensor banks, addressing said sensor boards, activating said light emitters and said light sensors in said addressed sensor boards, acquiring voltage output data from said light sensors in said addressed sensor boards, sequencing between addressing a sensor bank and a sensor board in said addressed sensor bank, and determining motion characteristics of said plurality of string striking means from said acquired output voltage data.

2. An apparatus as recited in claim 1, further comprising means for recording said key motion characteristics on a machine readable storage media.

3. An apparatus for determining motion characteristics of selected string striking means in a keyboard operated musical instrument having a plurality of string striking means, comprising:

(a) first and second sensor banks, each said sensor bank including a plurality of sensor boards, each said sensor board including a plurality of light emitters and corresponding light sensors, said light emitters and corresponding light sensors positioned adjacent said plurality of string striking means in said keyboard operated musical instrument, each said light sensor producing an output voltage responsive to intensity of sensed light reflected from a corresponding one of said string striking means; and (b) control means for addressing said first and second sensor banks, sequentially addressing said sensor boards in said sensor banks, activating said light emitters and said light sensors in said addressed sensor boards, acquiring voltage output data from said light sensors in said addressed sensor boards, alternating between addressing a sensor board in said first sensor bank and a sensor board in said second sensor bank, and determining motion characteristics of said string striking means from said acquired output voltage data.

4. An apparatus as recited in claim 3, further comprising means for recording said key motion characteristics on a machine readable storage media.

5. A method for determining motion characteristics of selected string striking means in a keyboard operated musical instrument having a plurality of string striking means, comprising the steps of:

(a) positioning a plurality of sensor boards adjacent to said plurality of string striking means, said sensor boards divided into a plurality of sensor banks, each said sensor board including a plurality of light emitting diodes, each said light emitting diode positioned adjacent to a corresponding one of said plurality of string striking means, each said sensor board including a plurality of photosensors, each said photosensor positioned adjacent to a corresponding light emitting diode and adjacent to said corresponding one of said plurality of string striking means;

(b) sequentially addressing said sensor banks;

(c) sequentially addressing said sensor boards;

(d) activating said light emitters and said light sensors in said addressed sensor boards;

(e) acquiring voltage output data from said light sensors in said addressed sensor boards, said voltage output data generated from sensed light reflected from said plurality of string striking means;

(f) sequencing between addressing a sensor bank and a sensor board in said addressed sensor bank; and (g) determining motion characteristics of said plurality of string striking means from said acquired output voltage data.

6. A method as recited in claim 5, further comprising the steps of recording said key motion characteristics on a machine readable storage media.

7. A method for determining motion characteristics of selected string striking means in a keyboard operated musical instrument having a plurality of string striking means, comprising the steps of:

(a) positioning a plurality of sensor boards adjacent to said plurality of string striking means, said sensor boards divided into first and second sensor banks, each said sensor board including a plurality of light emitting diodes, each said light emitting diode positioned adjacent to a corresponding one of said plurality of string striking means, each said sensor board including a plurality of photosensors, each said photosensor positioned adjacent to a corresponding light emitting diode and adjacent to said corresponding one of said plurality of string striking means;

(b) sequentially addressing said sensor banks;

(c) sequentially addressing said sensor boards;

(d) activating said light emitters and said light sensors in said addressed sensor boards;

(e) acquiring voltage output data from said light sensors in said addressed sensor boards, said voltage output data generated from sensed light reflected from said plurality of string striking means;

(f) alternating between addressing a sensor board in said first sensor bank and a sensor board in said second sensor banks; and (g) determining motion characteristics of said plurality of string striking means from said acquired output voltage data.

8. A method as recited in claim 7, further comprising the steps of recording said key motion characteristics on a machine readable storage media.

* * * * *